United States Patent [19]

Hartley

[11] 3,964,732

[45] June 22, 1976

[54] APPARATUS FOR MIXING MOLDING SAND

[75] Inventor: Nelson Hartley, Towson, Md.

[73] Assignee: Hartley Controls Corporation, Neenah, Wis.

[22] Filed: Dec. 30, 1974

[21] Appl. No.: 537,817

[52] U.S. Cl. ..... 259/10

[51] Int. Cl.[2] ..... B01F 7/06

[58] Field of Search..... 259/109, 110, 178 R, 259/178 A, 179, 9, 10, 25, 26, 45, 46, 68, 69

[56] References Cited

UNITED STATES PATENTS

| | | | |
|---|---|---|---|
| 1,555,964 | 10/1925 | Guedel | 259/178 R |
| 1,811,719 | 6/1931 | Johnson | 259/178 R |
| 1,820,954 | 9/1931 | Tuck | 259/178 R |
| 2,861,786 | 11/1958 | Madsen | 259/178 R |
| 2,961,224 | 11/1960 | Wright | 259/109 |
| 3,773,436 | 11/1973 | Lutz | 259/178 R |

*Primary Examiner*—Robert W. Jenkins
*Attorney, Agent, or Firm*—Joseph P. House, Jr.

[57] ABSTRACT

A molding sand mixer comprises an elongated tub with a pug mill type agitator therein. The agitator comprises a series of paddles mounted an an oblique angle on a shaft. Blade portions of the paddles which sweep the wall of the tub have a greater circumferential extent than shank portions of the paddles. The aggregate circumferential extent of the paddle blade portions almost fills the space around the periphery of the tub, when viewed in end elevation. There are, however, substantial circumferential gaps between the shank portions of the paddles when viewed in end elevation. The blade portions will substantially completely sweep the tub wall but sand in the vicinity of the shanks will be partially bypassed through said gaps. The paddle agitator is rotated at relatively high speed so that the sand is slapped and batted to cause it to fly and bounce in the tub. This aerates and ventilates the sand and removes heat therefrom, and breaks up clumps of agglomerated return sand for through mixing of the sand with water and blending of the sand with additives.

11 Claims, 10 Drawing Figures

APPARATUS FOR MIXING MOLDING SAND

BACKGROUND OF THE INVENTION

Pug mills have been previously used for mixing particulate material. An example appears in my U.S. Pat. No. 3,677,523 in which the pug mill treats rebound clay intended to be formed into bricks, pipe, etc. Heretofore, pug mills have not been successfully used to mix and blend green foundry sand.

SUMMARY OF THE INVENTION

In accordance with the present invention, a pug mill type of mixer is adapted by important changes on its structure to mix and blend green foundry sand. The mixer of the present invention is primarily characterized by the shape, disposition and arrangement of paddles on the shaft of the pug mill so that superior mixing and blending of molding sand is achieved. Important characteristics include:

1. Arranging the paddles on the shaft in one or more helical patterns in which each paddle is at the same small oblique angle to the axis of the tub.

2. The blade portions of the paddles have a greater circumferential extent than their shank portions. The aggregate circumferential extent of the blade portions at least almost fills the space around the periphery of the tub when viewed in end elevation, thus to completely sweep the arcuate wall of the tub.

3. The shank portions of the paddles are narrower than the blade portions, thus to leave substantial gaps between the shank portions of the paddles when viewed in end elevation. Accordingly, sand in the vicinity of the shanks will be partially bypassed by the shanks for improved blending of the sand ingredients.

4. The paddles have integral axially extending base plates which are curved to match the surface of the shaft to which they are attached. Accordingly, the oblique angle of the paddles to the tub axis is positively maintained by the mechanical interlock between the paddle base plates and the shaft.

5. The mixer wall is provided with a resilient liner and the blade is provided with a resilient edge, thus to inhibit encrustation of sand on the tub wall.

6. The paddle blades include releasable clamps into which resilient wiper blades are removably received.

7. Means are provided to restrict sand flow through the tub, thus to control sand retention time in the mixer.

8. The paddle agitator is rotated at relatively high speed so that the sand is slapped and batted to cause it to fly and bounce in the tub. This aerates and ventilates the sand and removes heat therefrom, and breaks up clumps of agglomerated return sand for through mixing of the sand with water and blending of the sand with additives.

Other objects, features and advantages of the present invention will appear from the disclosure herein.

DESCRIPTION OF THE PREFERRED EMBODIMENTS

Figure 1:
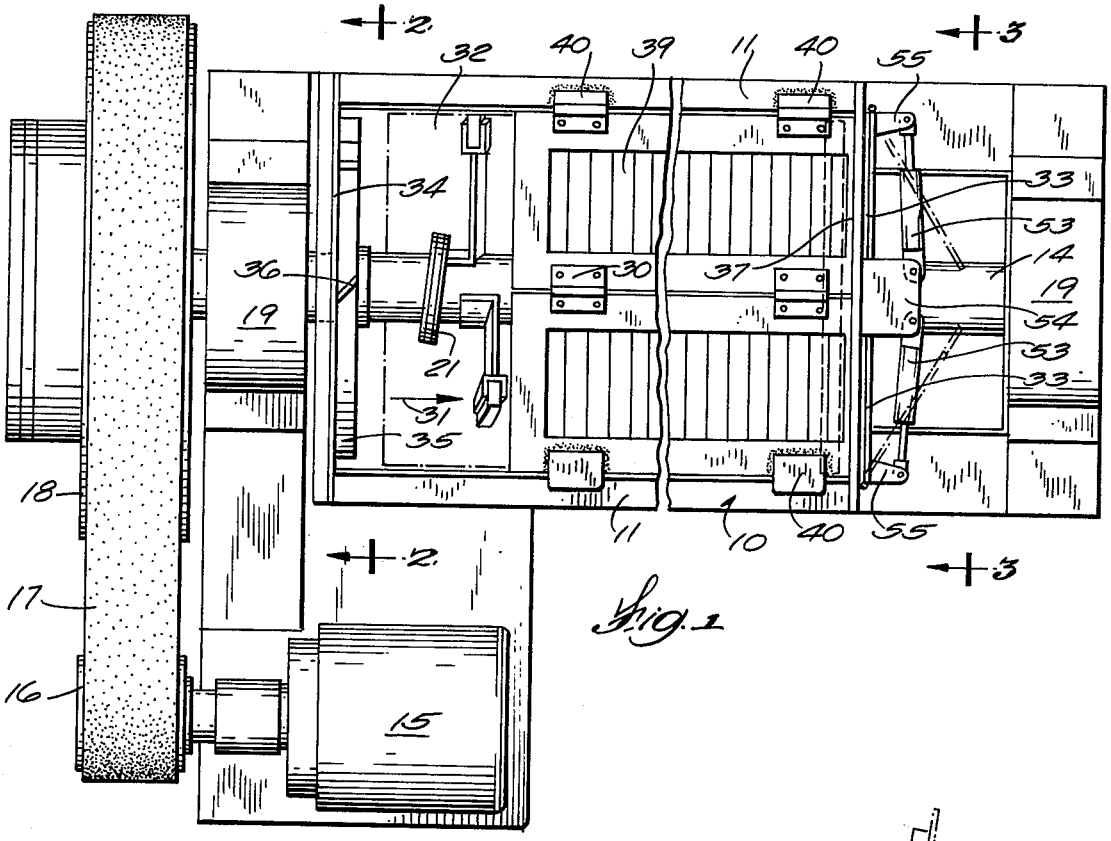
FIG. 1 is a fragmentary plan view of a mixer incorporating features of the present invention.
Figure 2:
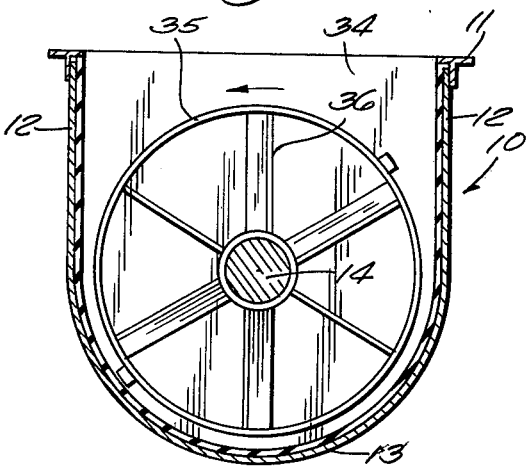
FIG. 2 is a cross section taken along the line 2—2 of FIG. 1.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

The mixer comprises an elongated tub shell 10 which has its upper edges stiffened by frame members 11. Tub shell 10 is supported from a base (not shown). In a typical embodiment, tub 10 is 12 feet long and 3 feet wide. The tub shell 10 has horizontally spaced vertical side walls 12 extended arcuately downwardly to form a semi-cylincrical trough 13. Substantially on the axis of the trough 13, an agitator shaft 14 is mounted on end bearing brackets 19. The shaft 14 is driven from one end by a motor 15 coupled through pulley 16, belt 17 and pulley wheel 18 to shaft end.

Figure 4:
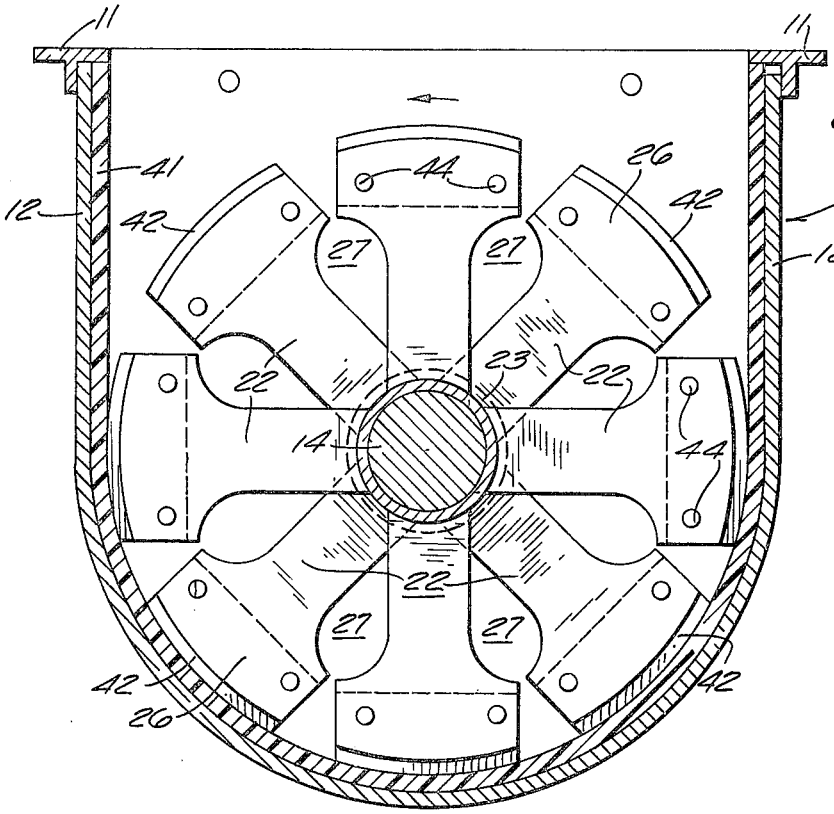
FIG. 4 is a transverse cross section taken through the tub of the mixer and showing the paddle disposition therein.
Figure 6:
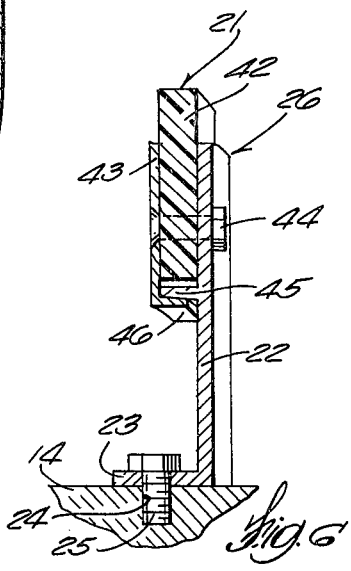
FIG. 6 is a fragmentary cross section taken along the line 6—6 of FIG. 5.
Figure 7:
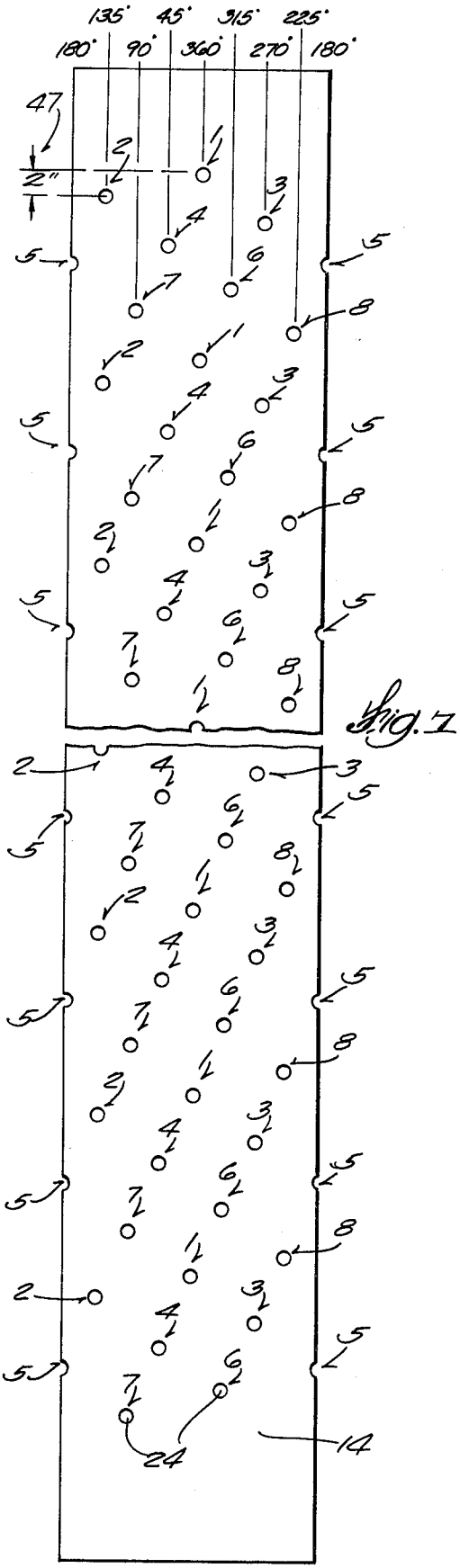
FIG. 7 is a developed plan view of the paddle shaft and showing the preferred pattern of the mounting holes for the paddles.

The shaft 14 carries a series of radially projecting paddles 21, the shape, disposition and relationship one to another of which constitutes an important feature of the present invention. Each paddle comprises a flat shank 22 from which a base plate or saddle-shaped foot 23 extends transversely as shown in FIG. 6. As best shown in FIG. 4, the base plate or saddle 23 is curved to match the curvature of the shaft 14. The shaft 14 is provided with a pattern of taped holes 24, as shown in FIG. 7, to receive mounting bolts 25 by which the paddles are rigidly mounted on the shaft. The curve of the paddle foot 23 mechanically interlocks the paddles on the shaft and precludes any twisting of the paddle once it is secured by bolt 25.

Figure 8:
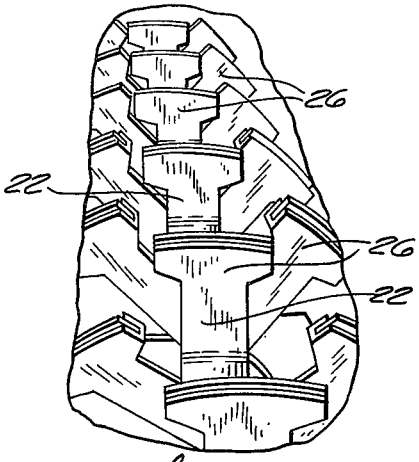
FIG. 8 is a fragmentary perspective end view of the mixer with its top open and showing the paddle disposition.

Each paddle 21 is provided at its end opposite foot 23 with an enlarged blade portion 26. As best shown in FIGS. 4 and 8, when viewed from an end of the shaft 14, the blade portions 26 of eight paddles, each spaced 45° arcuately about the shaft 14, have an aggregate circumferential extent sufficient to almost fill the space around the periphery of the tub. This arrangement insures full sweeping contact of the blades 26 with the wall 13 of the tub. However, for about three-quarters of the over-all radial extent of the paddles 21, the paddle shanks 22 are reduced in circumferential extent, as viewed in FIGS. 4 and 8, by about forty percent, thus leaving substantial circumferential gaps 27 between adjacent paddles. Accordingly, sand may be partially bypassed through the gaps 27 for better blending action of the sand and additives during operation of the mixer.

Figure 5:
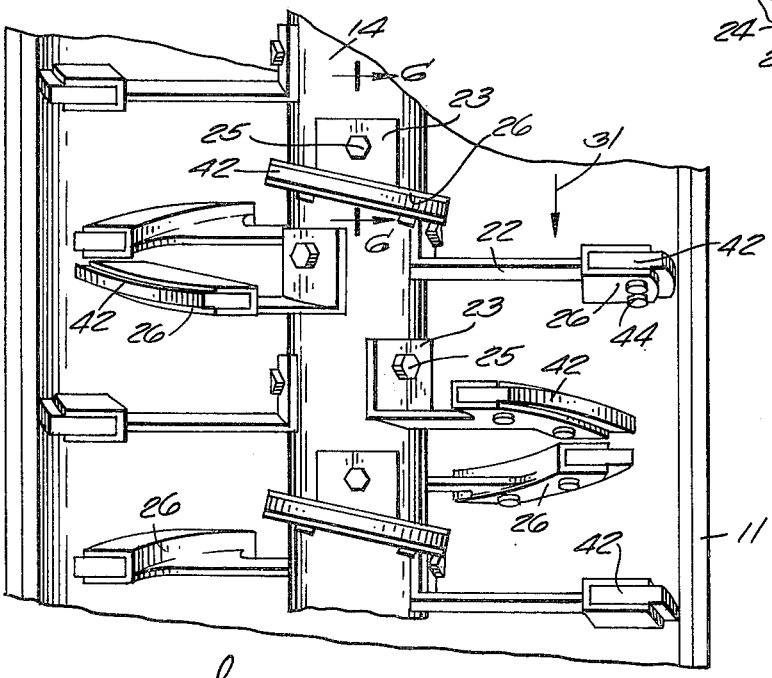
FIG. 5 is a fragmentary plan view through the open top of the mixer and showing the paddle disposition.
Figure 9:
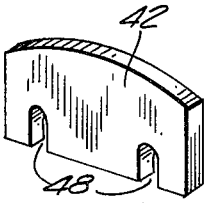
FIG. 9 is a perspective view of a wiper blade.

In the preferred embodiment, both the shank 22 and blade portion 26 of the paddles 21 are skewed or disposed at an oblique angle to the axis of rotation of the shaft 14. In the disclosed embodiment, the skew angle is 12°. Accordingly, rotation of the shaft 14 in the direction of arrow 28 in FIG. 4 will cause the sand in the tub to be moved by the skewed blades 26 and shanks 22 in the direction of arrow 31 in FIGS. 1 and 5. Some variation in the 12° angle is permissible, depending on specific conditions.

Sand and such conventional additives as sea coal, bentonite, water, etc., are added to the tub 10 through an open port 32 near the head end of tub 10 as shown in FIG. 1 and is moved in the direction of arrow 31 along the tub and exits therefrom at the tail end of the tub 10. In one embodiment of the invention the tail end of tub 10 has exit doors 33 which are shown in closed position in FIGS. 1 and 3 but which may be opened as hereinafter explained.

Figure 3:
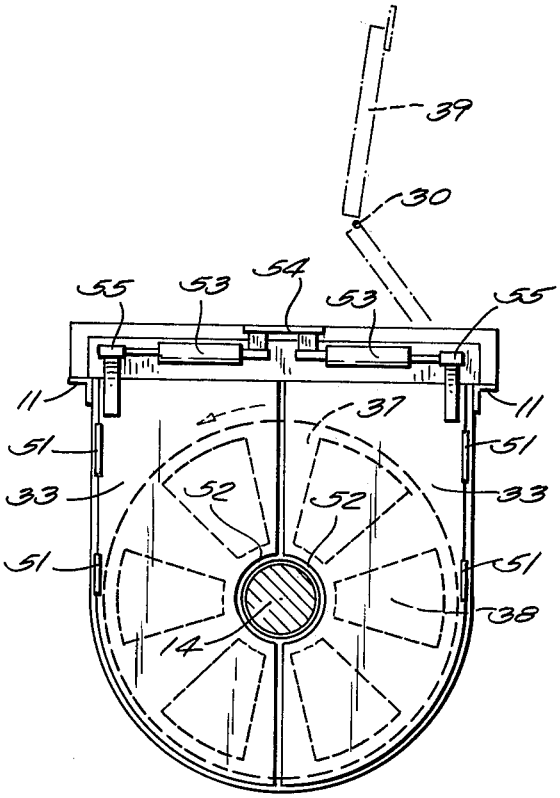
FIG. 3 is a cross section taken along the line 3—3 of FIG. 1.

Downstream from port 32 the top of tub 10 is covered by louvered doors 39 mounted on hinges 40 to frame member 11 and intermediate hinges 30 to each other so that doors 39 can be opened as shown in FIG. 3.

Near the head end wall 34 of the tub 10 shaft 14 is desirably provided with a scraper wheel 35 which has inclined blades 36 which scrape sand and other encrustations off of the end wall 34.

In the embodiment having exit doors 33 at the tail end of tub 10, the shaft 14 may be provided with a discharge disk 37 which has pie-shaped openings 38 to control outflow of sand from tub 10 through the doors 33 when they are opened. The size of the openings 38 may be changed for various sand formulations and conditions. The purpose of the apertured disk 37 is to function as a control gate to restrain flow of sand through the tub 10. Only a limited amount of sand is permitted to flow through the ports 38, thus regulating the retention time of sand in the tub for proper blending and mixing treatment by the paddles.

The inside wall of the tub 10 is desirably provided with a rubber, plastic or other tough resilient liner 41. Moreover, the blades 26 are also desirably provided with similar resilient wiper blades 42. The blades 42 have curved edges matching the curvature of the arcuate bottom 13 of the tub to insure close conformance therebetween. The fact that one or both of the tub wall liner 41 and the blade edge wiper strips 42 are fabricated of resilient material promotes dislodge of encrustations of sand, etc., from the wall and prevents buildup which would overload the motor 15 and otherwise impede and interfere with the mixing process.

The wiper blades 42 are adjustably and removably attached to the paddles 21 between the blade wall 26 of the paddle 21 and a clamping jaw 43 which is releasably attached to the blade wall 26 by bolts 44. Blade 26 has a laterally extending flange 45 and the jaw 43 has a complementary flange 46 which coacts with the flange 45 in holding the parts together.

As the wiping blades 42 become worn they may be readjusted in the clamp 43 to insure close conformance to the wall of the tub and to take up wear. Wiper blades 42 are slotted at 48 to fit around bolts 44 to permit such adjustment.

As best shown in FIG. 7, the shaft 14 is provided with a series of bolt holes 24 which mount the paddles 21 thereon. FIG. 7 is a developed view of the shaft 14, as though it were laid out flat. The holes 24 are arranged in groups of eight holes around the shaft 14, thus to produce the paddle arrangement shown in FIG. 4. The eight holes 24 are numbered successively 1–8, inclusive, in FIG. 7. The numbers start over for the next group of eight. Each successively numbered hole is axially spaced two inches from the preceding numbered hole. The eight holes are arranged in two helices, side by side. Holes, 1, 3, 5 and 7 are in one helix around the shaft and holes 2, 4, 6 and 8 are in the other helix. The holes in each helix are spaced on 4 inch centers axially along the shaft. In each helix, successive paddles are arcuately spaced around the periphery of the shaft at 90° intervals. The paddles in one helix are offset 45° with respect to the paddles in the other helix. Accordingly, successive paddles in the two helices are arcuately displaced around the periphery of the shaft at 45° intervals.

In operation, the shaft 14 is typically rotated at about 65 rpm. This is sufficient speed of rotation so that the skewed paddles impact against the sand in the tub to bat and throw the sand forwardly in the direction of arrow 31 from one blade to the next at the periphery of the paddles and permit bypassing of some of the sand through the gaps 27 as shown in FIG. 4. The resistance offered by the apertured disk 37, the weight and inertia of the sand, in combination with the forward thrust of the paddles produces a pressure condition on the sand which results in a superior mixing and blending of the sand with the additives and water. An ideally moldable sand results. Some increase or decrease in rpm is permissible, depending on specific conditions.

The mixer of the present invention breaks up agglomerated sand clumps by slapping and batting the sand. The sand is aerated and ventilated, thus removing heat which return sand has picked up in previous molding operations. The extracted heat escapes through the louvered doors 39 under pressure of the paddles 21 which act as fan blades to blow air through and over the sand. Under the action of the paddles, the sand bounces and flies about in the tub, thus resulting in a through blending and mixing of all ingredients.

The sand is typically retained in the mixer tub for about 1½ minutes, after which it is usually completely blended and ready for transport to the molders' hoppers.

Discharge doors 33 are mounted on hinges 51 as shown in FIGS. 1 and 3. These doors have cut out portions 52 around the shaft 14. During startup and time periods before the mixer is fully operative, the doors 33 are closed so that no sand can be discharged from the mixer. Doors 33 are operated by fluid cylinders 53 which have corresponding fixed ends pivotally mounted on a central fixed bracket 54 and corresponding free ends pivotally attached to crank brackets 55 secured to the doors 33. After startup, the doors can be opened by swinging them to their broken line positions shown in FIG. 1 and even farther, thus to permit discharge of sand from the mixer.

Figure 10:
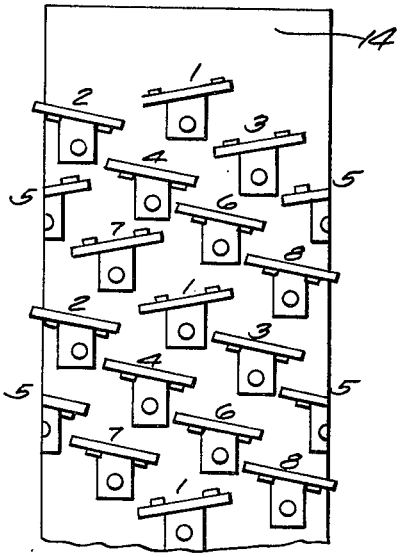
FIG. 10 is a diagrammatic view showing the disposition of certain paddles having reverse-pitch blades.

In another embodiment of the invention, the doors 33 and end disk 37 are omitted. In this embodiment the means to restrict sand flow through the tub to control sand retention time comprises a series of reverse pitch paddles. FIG. 10 diagrammatically illustrates such reverse-pitch paddles at the discharge end of the shaft 14 in hole positions 1, 3, 5, 7. The paddles at positions 2, 4, 6 and 8 have the standard forward pitch. Moreover, along the remaining length of the shaft 14, every eighth paddle is desirably given a reverse pitch. For example, each paddle in the No. 1 hole position is given a reverse pitch. This arrangement prevents sand from being discharged too quickly from the tub. Most of the paddles impel the sand toward the discharge end of the mixer, but the reverse-pitch paddles act in reverse to slow and control the rate of flow. The primary resistance is at the exit end of the tub, but the distribution of reverse-pitch paddles along a shaft throughout its length also restricts flow through the tub to control sand retention time.

The precise number and arrangement of the reverse-pitch paddles is subject to some variation as variations in the size of the mixer and the nature and character of the sand processed therein will influence the number and disposition of the reverse-pitch paddles. The afore-described arrangement is exemplary of mixers twelve feet long and three feet in diameter processing green foundry sand.

For many installations the embodiment utilizing reverse-pitch paddles is preferred over the embodiment utilizing the apertured disk 37 and doors 33, inasmuch as the reverse-pitch paddle arrangement is simplified and there are fewer parts subject to becoming clogged by encrusted sand.

What is claimed is:

1. A molding sand mixer comprising an elongated tub having an arcuate bottom, an elongated shaft extending axially within the tub, a series of paddles mounted on the shaft and extending radially toward the tub wall, power means for rotating said shaft, said paddles having blade and shank portions, at least said blade portions being disposed at an oblique angle to the tub axis to advance sand along the tub when the shaft rotates, the blade portions of the paddles having a greater circumferential extent than the shank portions, the aggregate circumferential extent of said blade portions at least almost filling the space around the periphery of said arcuate bottom of the tub when viewed in end elevation, there being substantial gaps between said shank portions of the paddles when viewed in end elevation, whereby the blade portions will substantially completely sweep the arcuate bottom of the tub, but some of the sand in the vicinity of the shanks may be missed by the shanks and be bypassed, said tub wall being lined with a resilient material and the paddle blade portions being provided with a resilient edge, said resilient material and said resilient edge coacting to inhibit sand encrustation of said wall.

2. A molding sand mixer comprising an elongated tub having an arcuate bottom, an elongated shaft extending axially within the tub, a series of paddles mounted on the shaft and extending radially toward the tub wall, power means for rotating said shaft, said paddles having blade and shank portions, at least said blade portions being disposed at an oblique angle to the tub axis to advance sand along the tub when the shaft rotates, the blade portions of the paddles having a greater circumferential extent than the shank portions, the aggregate circumferential extent of said blade portions at least almost filling the space around the periphery of said arcuate bottom of the tub when viewed in end elevation, there being substantial gaps between said shank portions of the paddles when viewed in end elevation, whereby the blade portions will substantially completely sweep the arcuate bottom of the tub, but some of the sand in the vicinity of the shanks may be missed by the shanks and be bypassed, means to restrict sand flow through the tub, thus to control sand retention time in the mixer, said means comprising a disk gate on said shaft at the discharge end of the tub.

3. A molding sand mixer comprising an elongated tub having an arcuate bottom, an elongated shaft extending axially within the tub, a series of paddles mounted on the shaft and extending radially toward the tub wall, power means for rotating said shaft, said paddles having blade and shank portions, at least said blade portions being disposed at an oblique angle to the tub axis to advance sand along the tub when the shaft rotates, the blade portions of the paddles having a greater circumferential extent than the shank portions, the aggregate circumferntial extent of said blade portions at least almost filling the space around the periphery of said arcuate bottom of the tub when viewed in end elevation, there being substantial gaps between said shank portions of the paddles when viewed in end elevation, whereby the blade portions will substantially completely sweep the arcuate bottom of the tub, but some of the sand in the vicinity of the shanks may be missed by the shanks and be bypassed, means to restrict sand flow through the tub, thus to control sand retention time in the mixer, said means comprising a series of paddles having reverse pitch blades on said shaft at the discharge end of the tub.

4. The mixer of claim 1 in which the paddle shanks have integral axially extending base plates curved to match the surface of the shaft to mechanically lock the paddle to the shaft and by which the oblique angle of the blade portions of the paddle to the tub axis is positively maintained.

5. The mixer of claim 3 in which said means further comprises additional paddles having reverse-pitch blades along said shaft.

6. The mixer of claim 3 in which said power means rotates the shaft at such a speed that the sand is slapped and batted to cause it to bounce and fly in the tub and to break up clumps of agglomerated return sand.

7. A continuous molding sand mixer comprising an elongated tub having a head end and a tail end, an elongated shaft extending axially with the tub, an entry port at the head end of the tub and a discharge opening at the tail end of the tub, a series of paddles mounted on the shaft substantially equidistant therefrom and adjacent the tub wall, power means for rotating the shaft, most of said paddles being forwardly pitched in one direction to advance sand along the tub from its head end toward its tail end and out said discharge opening when the shaft rotates, some of said paddles being reversely pitched in the opposite direction and disposed in the path of sand impelled by the forwardly pitched paddles to restrict sand flow through the tub, thus to control sand retention time in the mixer and restrict premature discharge thereof through said discharge opening.

8. The mixer of claim 7 in which said reverse pitch paddles are primarily at the tail end of the tub.

9. The mixer of claim 8 in which some of said reverse pitch paddles are distributed along said tub.

10. The mixer of claim 7 in which the paddles have shanks with integrally extending base plates curved to match the surface of the shaft to mechanically lock the paddle to the shaft and by which the pitch of the paddle to the tub axis is maintained.

11. A continuous molding sand mixer comprising an elongated tub having a head end and a tail end, an elongated shaft extending axially within the tub, an entry port at the head end of the tub and a discharge opening at the tail end of the tub, a series of paddles mounted on the shaft, power means for rotating the shaft, most of said paddles being pitched in one direction to advance sand along the tub from its head end toward its tail end and out said discharge opening when the shaft rotates, some of said paddles being reversely pitched to restrict sand flow through the tub, thus to control sand retention time in the mixer and restrict premature discharge thereof through said discharge opening, said tub wall being lined with a resilient material and said paddles being provided with resilient edges, said resilient material and said resilient edges coacting to inhibit sand encrustation of said wall.

* * * * *